US008500508B2

(12) United States Patent
Yamada et al.

(10) Patent No.: US 8,500,508 B2
(45) Date of Patent: Aug. 6, 2013

(54) TRANSFORMABLE TOY

(75) Inventors: Satoshi Yamada, Ichikawa (JP); Fujio Nobata, Tokyo (JP)

(73) Assignee: Spin Master Ltd., Toronto, Ontario (CA)

( * ) Notice: Subject to any disclaimer, the term of this patent is extended or adjusted under 35 U.S.C. 154(b) by 86 days.

(21) Appl. No.: 12/821,890

(22) Filed: Jun. 23, 2010

(65) Prior Publication Data

US 2010/0252990 A1 Oct. 7, 2010

Related U.S. Application Data

(63) Continuation of application No. 11/644,913, filed on Dec. 22, 2006, now Pat. No. 7,785,168.

(30) Foreign Application Priority Data

Feb. 20, 2006 (JP) ..... 2006-041918

(51) Int. Cl.
*A63H 33/26* (2006.01)

(52) U.S. Cl.
USPC ..... 446/130; 446/139; 446/137; 446/269

(58) Field of Classification Search
USPC ..... 446/129–132, 137, 139, 269, 298, 446/308–311, 376, 390, 486, 487; 273/108, 273/456
See application file for complete search history.

(56) References Cited

U.S. PATENT DOCUMENTS 3,589,059 A * 6/1971 Caswell ..... 446/39
3,684,292 A * 8/1972 Penrod et al. ..... 273/156
4,132,032 A * 1/1979 Triska ..... 446/132
4,575,348 A 3/1986 Wiggs et al.
4,606,618 A 8/1986 Geller
5,076,623 A 12/1991 Richards
5,310,378 A * 5/1994 Shannon ..... 446/268

(Continued)

FOREIGN PATENT DOCUMENTS

CA 1328474 4/1994
FR 2559072 8/1985

(Continued)

OTHER PUBLICATIONS

Canadian Office Action issued by the Canadian Intellectual Property Office, dated Jan. 23, 2008.

(Continued)

*Primary Examiner* — Alvin Hunter
*Assistant Examiner* — John E Simms, Jr.
(74) *Attorney, Agent, or Firm* — Cozen O'Connor

(57) ABSTRACT

A toy with an exterior structure. Constructed to transform from a rollable first shape to a second shape. An interior structure inside the exterior structure is endowed with a magnetic body that moves by way of a magnetic force that acts from the exterior of the toy, an interior locking portion that moves simultaneously with the movement of this magnetic body, and a biasing member that effects a force which moves or turns this interior locking portion in a particular direction. If the magnetic force does not act from the exterior of the toy, the first shape of the exterior structure maintained. In the event that a magnetic force has acted from the exterior of the said toy, the exterior structure transforms from the first shape to the second shape.

9 Claims, 12 Drawing Sheets

U.S. PATENT DOCUMENTS

| | | | | |
|---|---|---|---|---|
| 5,893,791 | A * | 4/1999 | Wilkinson | 446/456 |
| 5,916,007 | A * | 6/1999 | Maxim | 446/130 |
| 6,086,449 | A * | 7/2000 | Sharp | 446/486 |
| 6,719,606 | B1 * | 4/2004 | Mukensturm | 446/369 |
| 6,761,612 | B1 * | 7/2004 | Pencil et al. | 446/310 |
| 2003/0016443 | A1 | 1/2003 | Shin | |
| 2006/0009115 | A1 * | 1/2006 | Saucier | 446/268 |
| 2010/0291831 | A1 * | 11/2010 | Yamada | 446/129 |

FOREIGN PATENT DOCUMENTS

| | | |
|---|---|---|
| GB | 2217218 | 10/1989 |
| JP | 38-9155 | 5/1963 |
| JP | 58-179191 | 11/1983 |
| JP | 62-111092 | 7/1987 |
| JP | 1-112893 | 7/1989 |
| JP | 2003-190648 | 7/2003 |
| JP | 3112866 | 8/2005 |
| WO | WO/0156674 | 8/2001 |

OTHER PUBLICATIONS

European Search Report dated Jun. 25, 2007 issued in a corresponding application No. 07250653.8-2318.

European Search Report dated Jul. 3, 2008 issued in a corresponding application No. 07250653.8-2318.

European Office Action dated May 5, 2009 issued in a corresponding application No. 07250653.8-2318.

Australian Office Action dated May 26, 2010 issued in corresponding application No. 2007200737.

Canadian Office Action dated Jan. 23, 2008 issued in corresponding application No. 2,547,539.

European Search Report Application No. 07250653.8-2318 dated Mar. 7, 2008.

Japan International Search Report dated May 15, 2007.

* cited by examiner

TRANSFORMABLE TOY

CROSS REFERENCE TO RELATED APPLICATIONS

This application is a continuation of U.S. patent application Ser. No. 11/644,913 which was filed with the U.S. Patent and Trademark Office on Dec. 22, 2006 now U.S. Pat. No. 7,785,168. Priority is claimed for this invention and application, corresponding Japan Application No. 2006-41918 filed on Feb. 20, 2006 respectively.

BACKGROUND OF THE INVENTION

1. Field of the Invention

The present invention relates to a toy, and in particular to a toy that transforms by means of the action of a magnetic force.

2. Description of the Related Art

Historically, there have been toys that have been proposed and that have come into practical use which have brought forth a variety of game effects by means of the action of a magnetic force. For example, there was a toy proposed, equipped with a doll furnished with a permanent magnet and a house frame furnished with a magnetic substance, which expanded by means of a magnetic force (refer to patent document 1, for example). In such a toy, in the event that the doll was brought near to the house frame, the expansion of the house frame and the opening of the door were automatically realized by means of the magnet furnished within the doll attracting the magnetic substance furnished within the house frame.

SUMMARY OF THE INVENTION

Although historical magnetic-force-expansion-style toys (the house frame toy, for example) like that defined in the said patent document 1 must have a mechanism installed within the interior thereof that acts by means of a magnetic force, because these toys can only be used by placing them in particular locations, there were few restrictions placed upon the shapes and sizes thereof in their design.

However, in the event that a shooting game is to be developed, for example, in which a shooter that shoots magnetic-force-expansion-style toys is used to send these toys running through a travel motion toy furnished with rails and various traps, although the miniaturization and amelioration of the toy itself is necessary, the following problems emerge under such circumstances.

Namely, in order to realize the miniaturization of magnetic-force-expansion-style toys, although both (1) space to incorporate a variety of mechanisms that operate by means of a magnetic force, and (2) space to house the expanded components, must be established, securing both of these spaces within the interior of a small toy involves considerable design difficulties. Further, in order to potentiate a shooting game in which magnetic-force-expansion-style toys are used, these toys must be given rollable shapes (spherical shapes, for example), but achieving the miniaturization of such toys while still employing rollable shapes involves considerable design difficulties, and this has not yet been realized by means of prior art.

The present invention is in consideration of such circumstances, and aims to dramatically increase the commercial value of the toy and impart fresh wonderment and intellectual excitement to its players by means of making the magnetic-force-expansion-style toy rollable.

In order to achieve the said aims, the toy pertaining to the present invention is characterized by being a toy equipped with an exterior structure constructed in such a way that it transforms from a rollable first shape to a second shape, and an interior structure contained within the interior of this exterior structure, and wherein the exterior structure is endowed with a transformation means that transforms the exterior locking portion and the exterior structure from the first shape to the second shape, and wherein the interior structure is endowed with a magnetic body that moves by means of a magnetic force that acts from the exterior of the toy, an interior locking portion that moves simultaneously with the movement of the magnetic body, and a biasing means that effects a force which moves or turns this interior locking portion in a particular direction, and wherein, in the event that a magnetic force does not act from the exterior of the toy, a locked state of the interior locking portion, which moved or turned in a particular direction by means of the force of the biasing means, and the exterior locking portion is realized, and the first shape of the exterior structure is thereby maintained, and wherein, on the contrary, in the event that a magnetic force has acted from the exterior of the toy, the magnetic body and the interior locking portion resist the force of the biasing means and move or turn, the locked state of the interior locking portion and the exterior locking portion is thereby released, and the exterior structure thereby transforms from the first shape to the second shape by means of the transformation means.

According to such a construction, in the event that a magnetic force does not act from the exterior of the toy, a locked state of the interior locking portion, which moved or turned in a particular direction by means of the force of the biasing means, and the exterior locking portion is realized, and the rollable first shape (a roughly spherical shape, for example) of the exterior structure is thereby maintained. On the contrary, in the event that a magnetic force has acted from the exterior of the toy, the magnetic body and interior locking portion resist the force of the biasing means and move or turn, the locked state of the interior locking portion and exterior locking portion is thereby released, and the exterior structure thereby transforms from the first shape to the second shape by means of the transformation means.

Namely, the toy can maintain the rollable first shape until a force (magnetic force) that attracts the magnetic body acts from the exterior of the toy. Consequently, the realization of games such as shooting games in which the toy pertaining to the present invention is sent running through a travel motion toy, for example, is potentiated. Further, simply by effecting a magnetic force from the exterior of the toy, the magnetic body and the interior locking portion within the interior of the toy move or turn, and the locked state of the interior locking portion of the interior structure and exterior locking portion of the exterior structure is thereby released, and the toy can hence automatically transform from the first shape to the second shape. Consequently, by positioning a magnet in a particular location on a travel motion toy, for example, the sudden transformation of the toy traveling on the travel motion toy in the rollable first shape to a different shape (the second shape), on this particular location, is potentiated. Further, because the mechanism for transforming the toy from the first shape to the second shape is relatively simple, the realization of the miniaturization of the toy is also potentiated. Hereby, the commercial value of the toy can be dramatically increased, and the impartation of fresh wonderment and intellectual excitement to its players is potentiated.

In the said toy, an interior locking portion, which moves integrally with the magnetic body in the interval between the central location and near-surface location of the toy in a rectilinear fashion, can be employed. In such an event, a biasing means, which effects a force that moves the interior locking portion from the near-surface location towards the central location of the toy, can be employed.

Further, in the said toy, the interior structure can be furnished with a first interior turning portion that turns integrally with the magnetic body upon a first interior turning axis, and a second interior turning portion that turns upon a second interior turning axis simultaneously with this first interior turning portion. In such an event, an interior locking portion that turns integrally with the second interior turning portion can be employed, as well as a biasing means that effects a force which turns the second interior turning portion and the interior locking portion in a particular direction.

Further, in the said toy, the exterior structure can be furnished with a first exterior turning component that turns upon a first exterior turning axis, and a second exterior turning component that turns upon a second exterior turning axis. In such an event, a transformation means that employs a turning means that effects a force which turns the first and second exterior turning components can be employed. Further, a construction can be employed in which, in the event that a magnetic force acts from the exterior of the toy and the locked state of the interior locking portion and exterior locking portion is released, the turning of the first exterior turning component and the turning of the second exterior turning component is realized, in this order.

Further, in the said toy, it is desirable for the exterior structure to employ a construction in which it is restorable from the second shape to the first shape, and in which, in the event that the exterior structure has been restored from the second shape to the first shape, a locked state of the interior locking portion and exterior locking portion is thereby realized, and the first shape of the exterior structure is thereby maintained once again.

If such a construction is employed, even after the toy has transformed from the first shape to the second shape by means of the action of a magnetic force, the toy can be restored to the rollable first shape and re-used, and games such as shooting games can hence be carried out repeatedly.

In another aspect, moreover, the present invention relates to a toy comprising a main body element and at least one first moveable element associated with said main body and moveable with respect thereto from a first position adjacent said main body, to a second position in which at least a portion of a said first moveable element has moved away from said main body, said at least one first moveable element being permanently biased toward said second position, and being provided with catch means co-operable with releasable latch means in said main body element to maintain at least one said first moveable element in said first position until said latch means is released.

Preferably, said main body element, together with said at least one first moveable element, are a first shape when said at least one first moveable element is in said first position, and a second shape when said at least one first moveable element is in said second position.

The first shape may be selected from the group consisting of spheres, cubes, tetrahedrons, pyramids, triangular prisms, egg shapes, parallelpipids, cylinders, discus shapes, toruses, teardrops, lozenges, animal shapes, planet shapes, robot shapes, vehicle shapes, building shapes, tree shapes, sports equipment related shapes, weapons shapes, character-head shapes, and the like.

In the most advantageous embodiment, the releasable latch is biased to a position in engagement with said catch.

Furthermore, the releasable latch will preferably be provided with a magnet, whereby said releasable latch may be moved out of engagement with said catch by attraction of said magnet to a ferrous or other magnetic metal surface, or a second magnet.

In a most preferred form of the present invention at least one second moveable element is hinged to said at least one first moveable element and moveable from a close position adjacent said at least one first moveable element, to an open position away from said at least one first moveable element, and said at least one second moveable element is biased toward said open position, and foldable to said closed position, said at least one second moveable element being restrained against movement toward said open position while said catch is in engagement with said releasable latch.

According to the present invention, because the magnetic-force-expansion-style toy can be made rollable, the commercial value of the toy can be dramatically increased, and the impartation of fresh wonderment and intellectual excitement to its players is potentiated.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings.

In drawings that illustrate the present invention by way of example.

DETAILED DESCRIPTION OF THE PRESENTLY PREFERRED EMBODIMENTS

Figure 1:
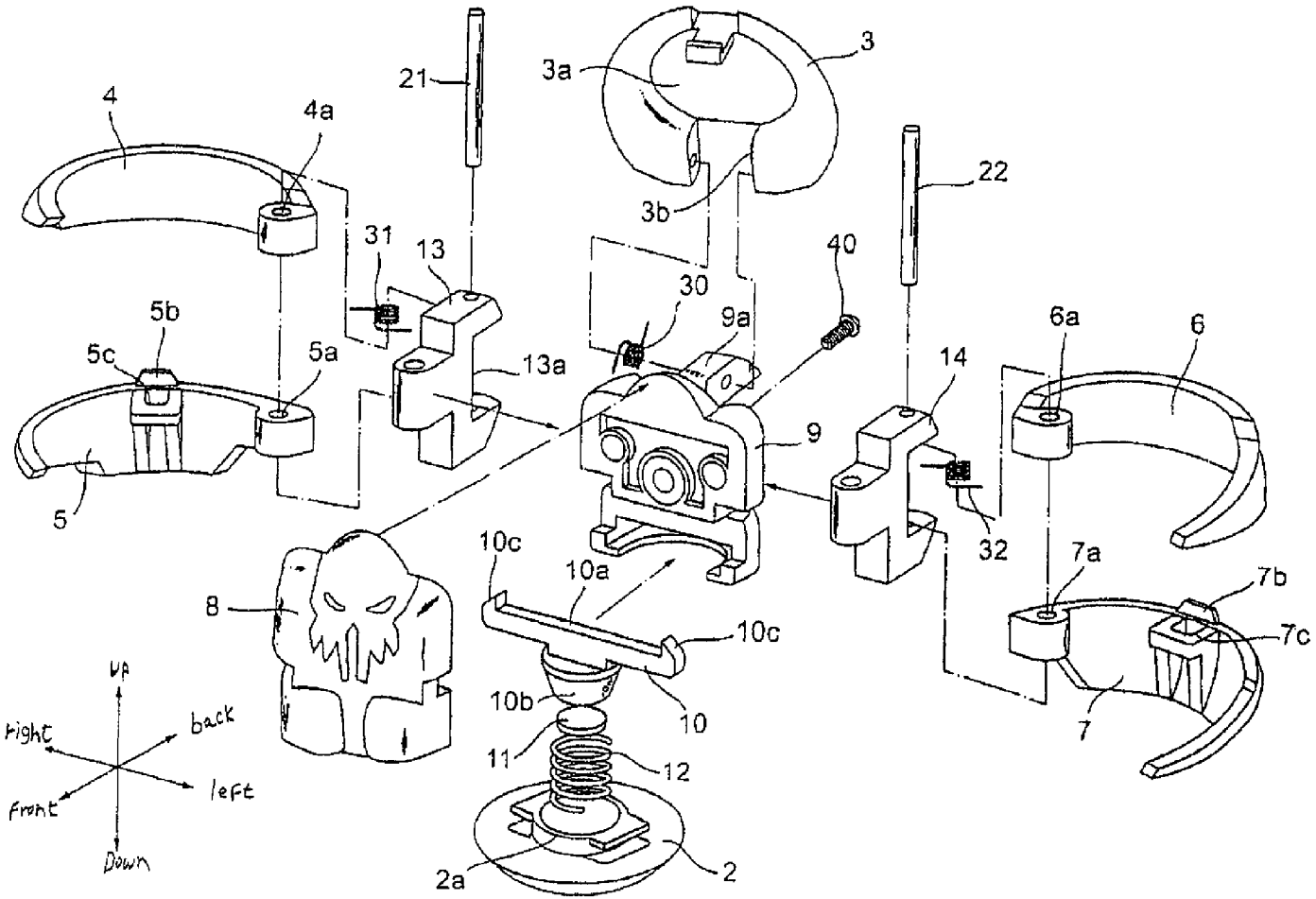
FIG. 1 is an exploded perspective view of the toy pertaining to embodiment 1 of the present invention.
Figure 2:
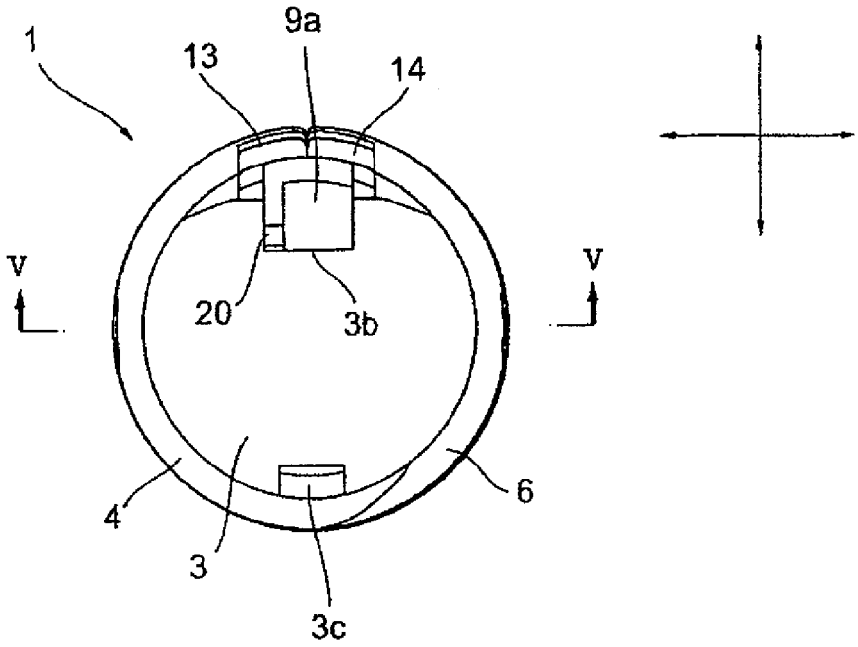
FIG. 2 is a plane view of the toy shown in drawing 1, showing a pre-transformation state.
Figure 3:
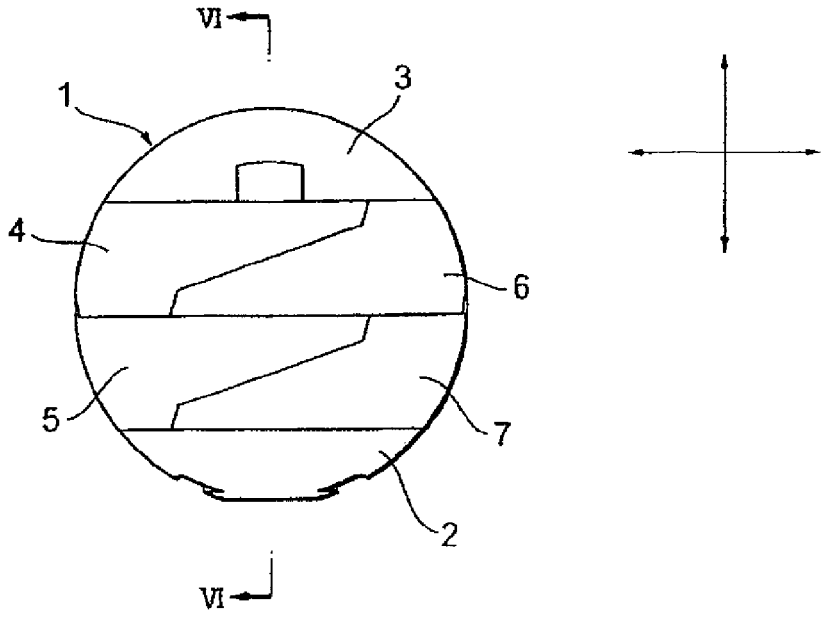
FIG. 3 is a front view of the toy shown in drawing 1, showing a pre-transformation state.
Figure 4:
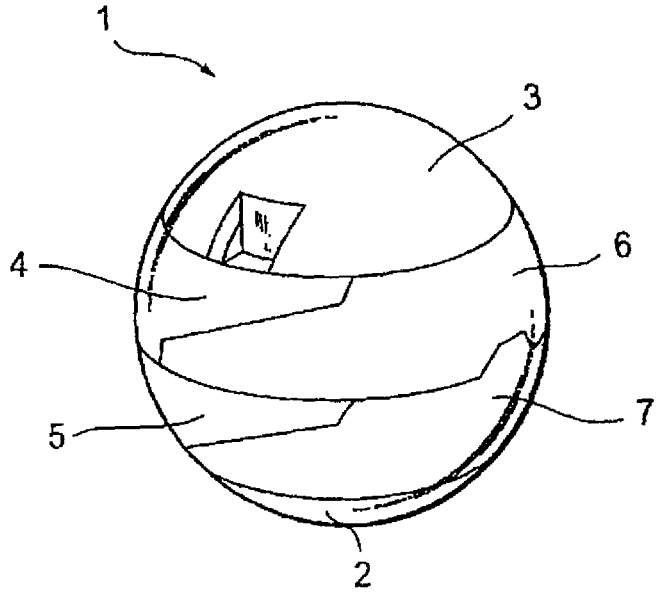
FIG. 4 is a perspective view of the toy shown in drawing 1, showing a pre-transformation state.
Figure 5A:
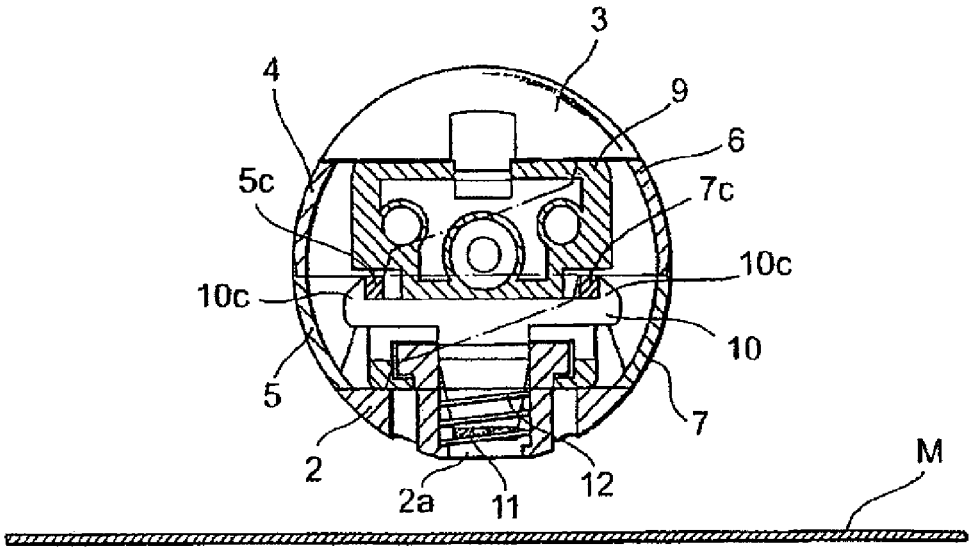
FIGS. 5(*a*) and 5(*b*) are two fragmentary sectional views of the V-V section in drawing 2 of the toy shown in drawing 1, (a) showing a pre-transformation state, and (b) showing a post-transformation state.
Figure 5B:
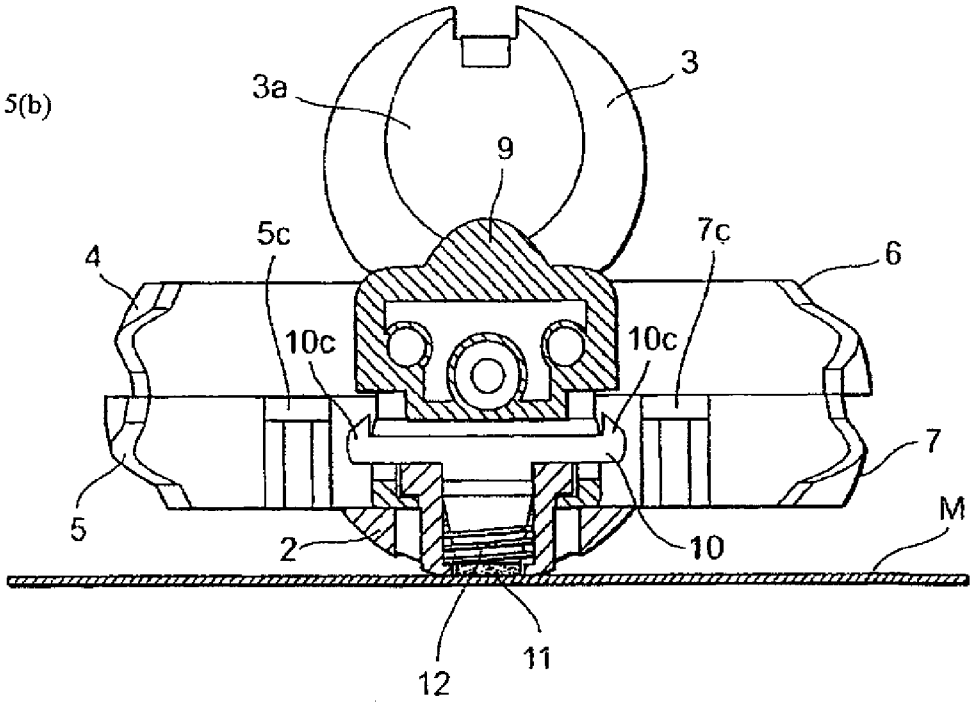
Figure 6A:
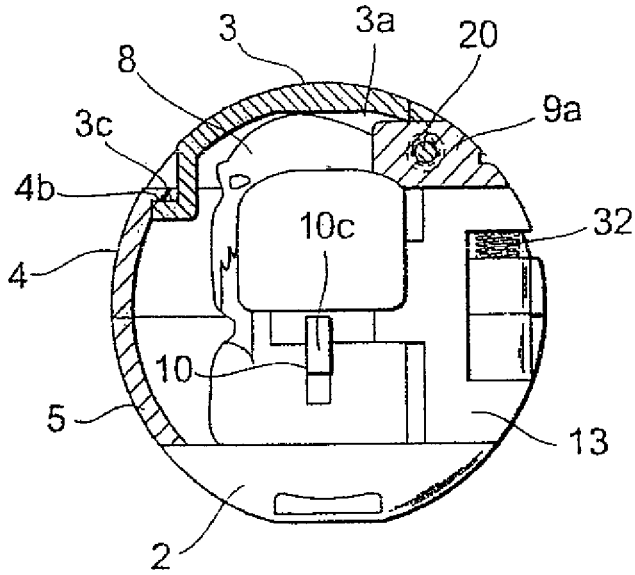
FIGS. 6(*a*) and 6(*b*) are two fragmentary sectional views of the VI-VI section in drawing 3 of the toy shown in drawing 1, (a) showing a pre-transformation state, and (b) showing a post-transformation state.
Figure 6B:
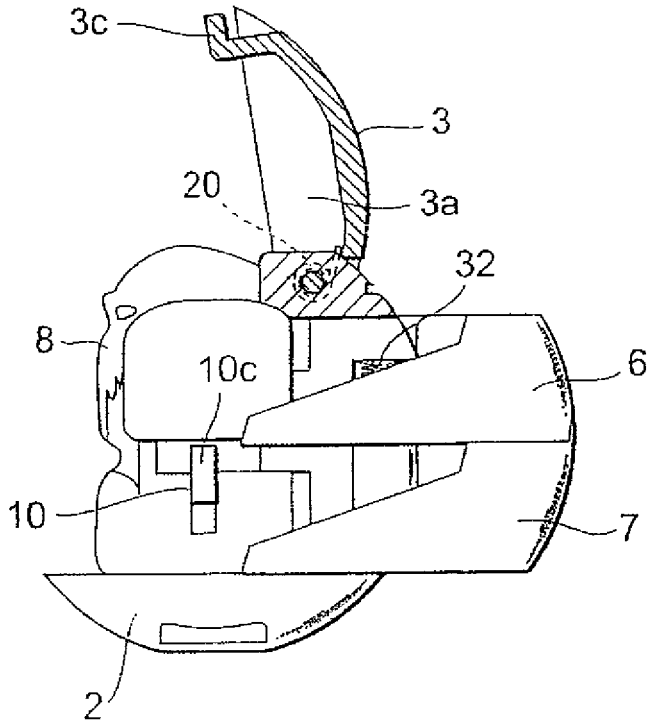
Figure 7:
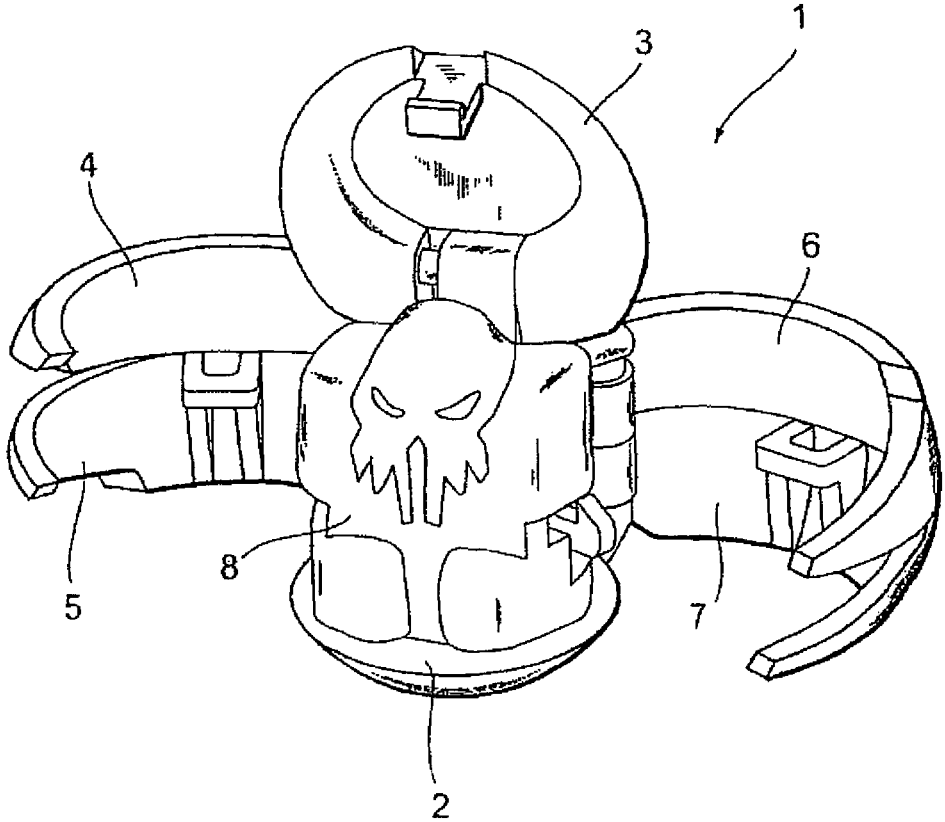
FIG. 7 is a perspective view of the toy shown in drawing 1, showing a post-transformation state.
Figure 8:
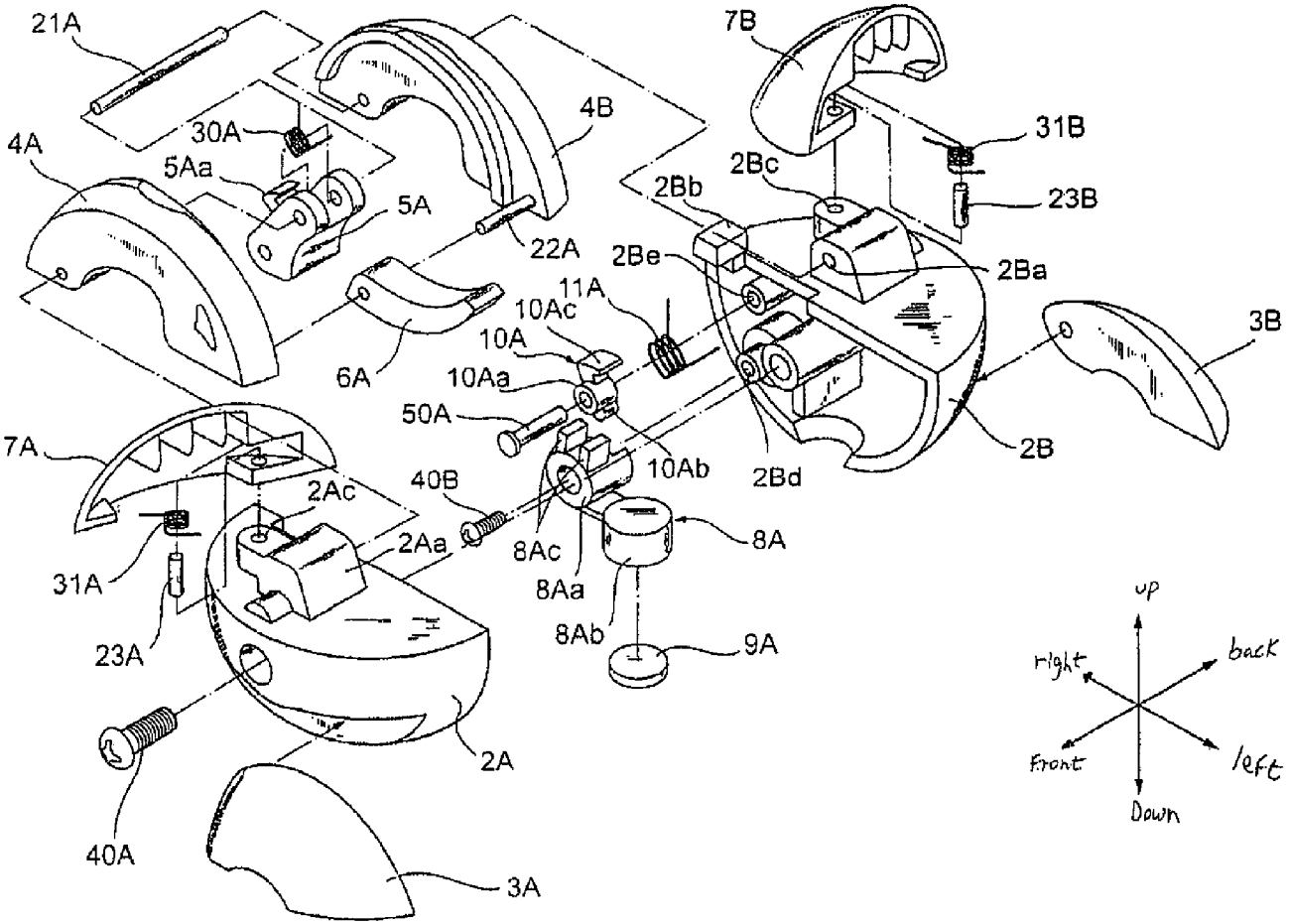
FIG. 8 is an exploded perspective view of the toy pertaining to embodiment 2 of the present invention.
Figure 9:
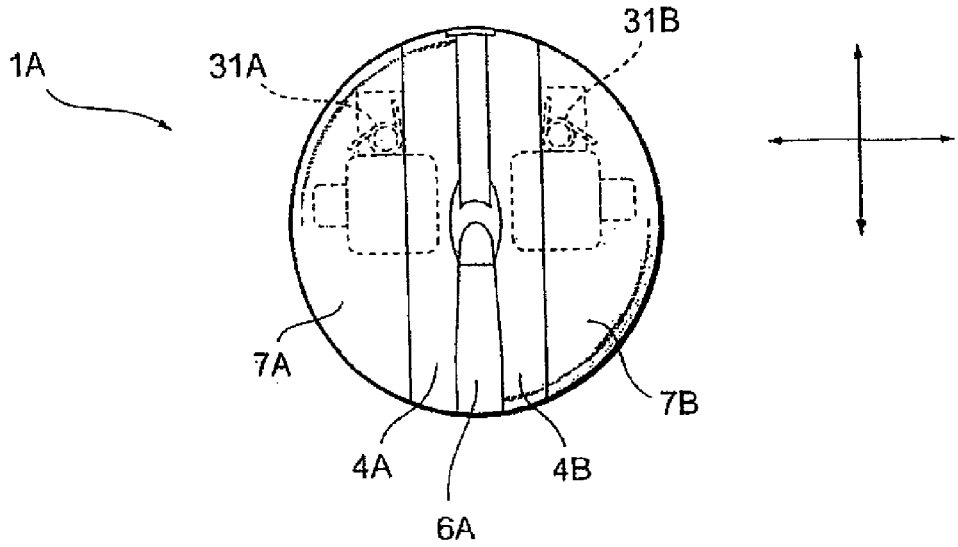
FIG. 9 is a plane view of the toy shown in drawing 8, showing a pre-transformation state.
Figure 10:
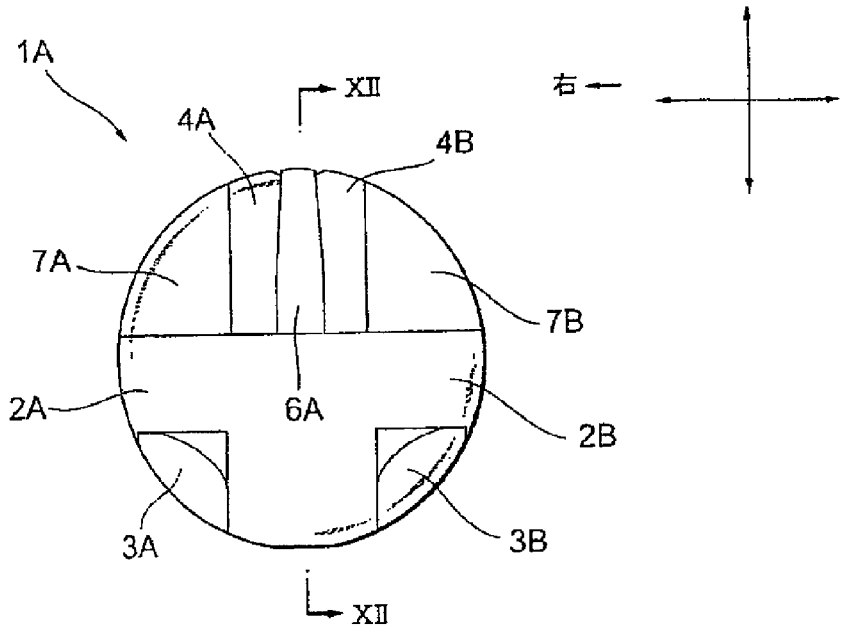
FIG. 10 is a front view of the toy shown in drawing 8, showing a pre-transformation state.
Figure 11:
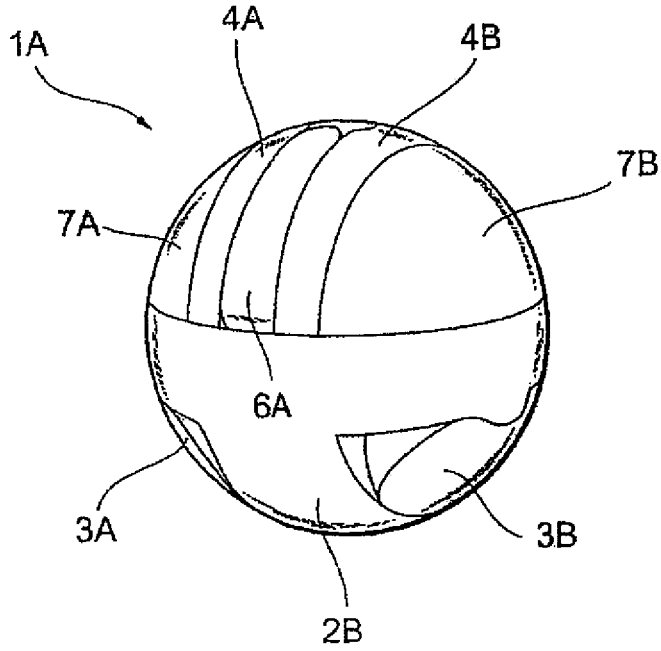
FIG. 11 is a perspective view of the toy shown in drawing 8, showing a pre-transformation state.
Figure 12A:
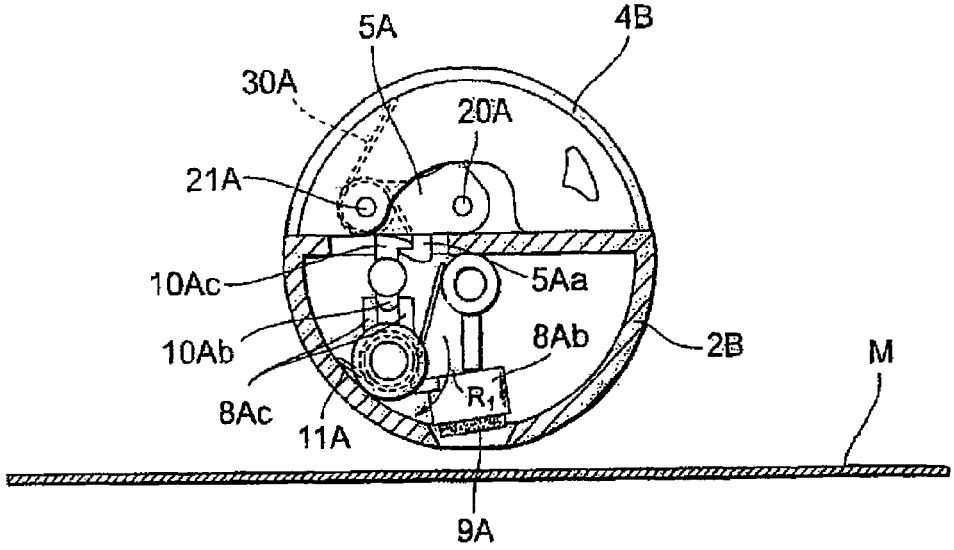
FIGS. 12(*a*) and 12(*b*) are two fragmentary sectional views of the XII-XII section in drawing 10 of the toy shown in drawing 8, (a) showing a pre-transformation state, and (b) showing a post-transformation state.
Figure 12B:
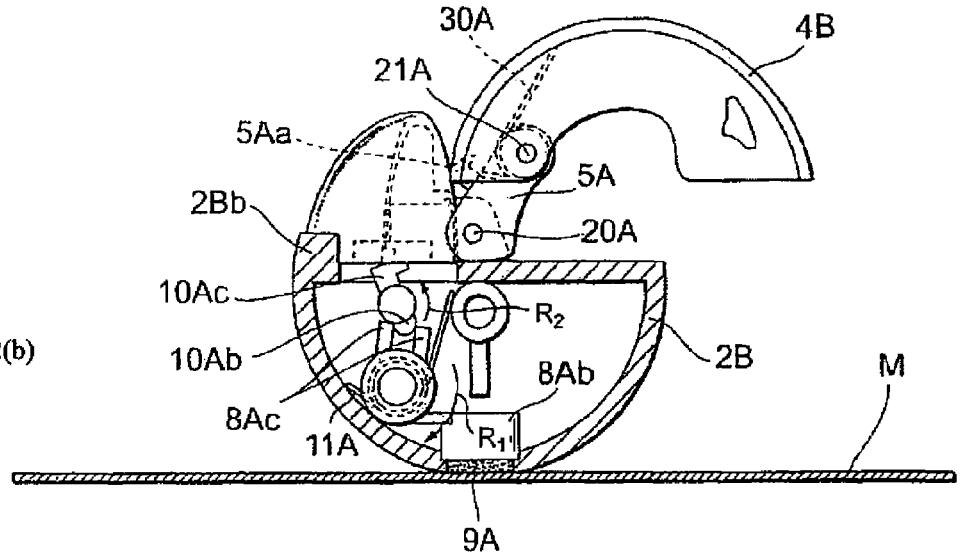
Figure 13:
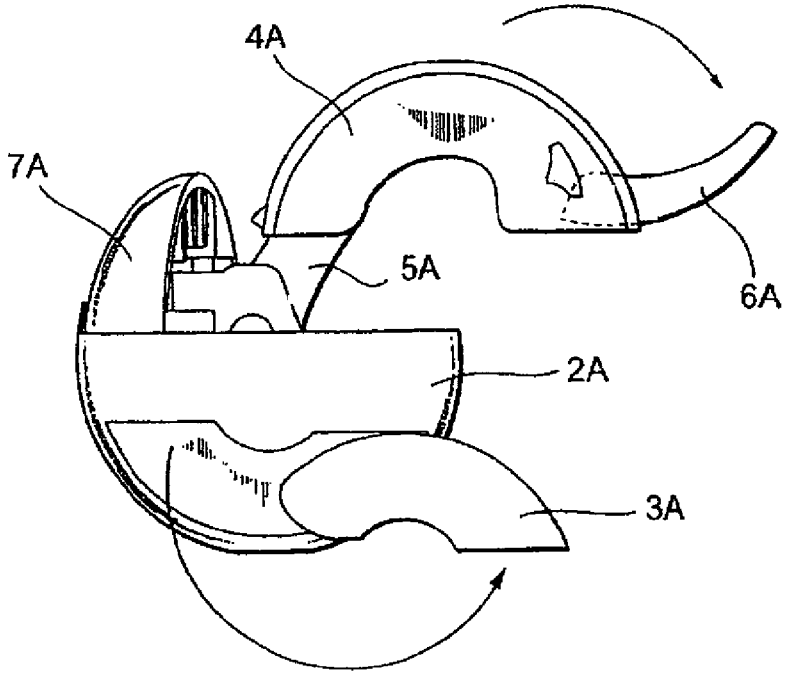
FIG. 13 is a left side view of the toy shown in drawing 8, showing a post-transformation state.
Figure 14:
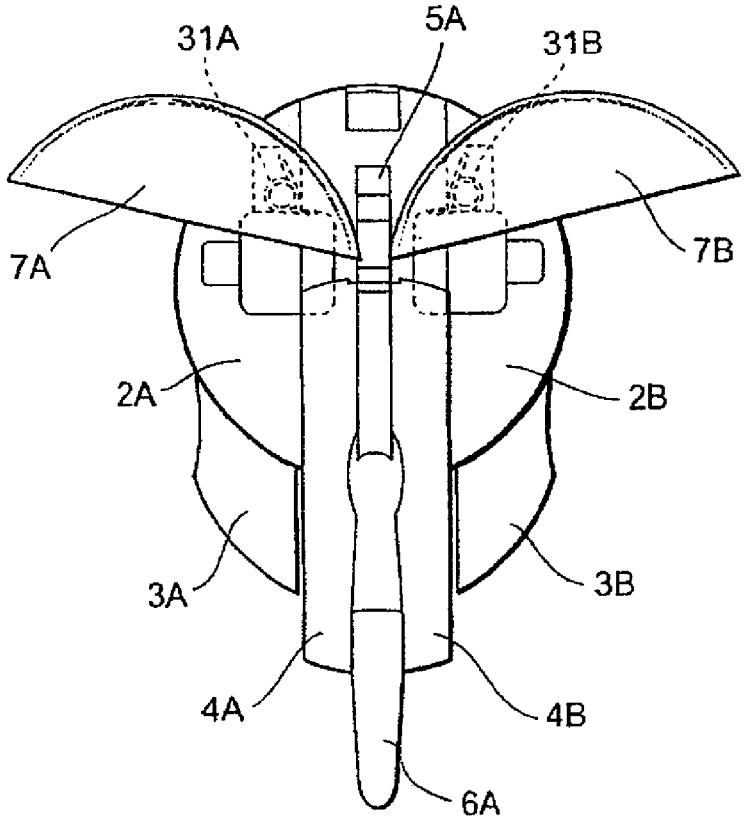
FIG. 14 is a plane view of the toy shown in drawing 8, showing a post-transformation state.
Figure 15:
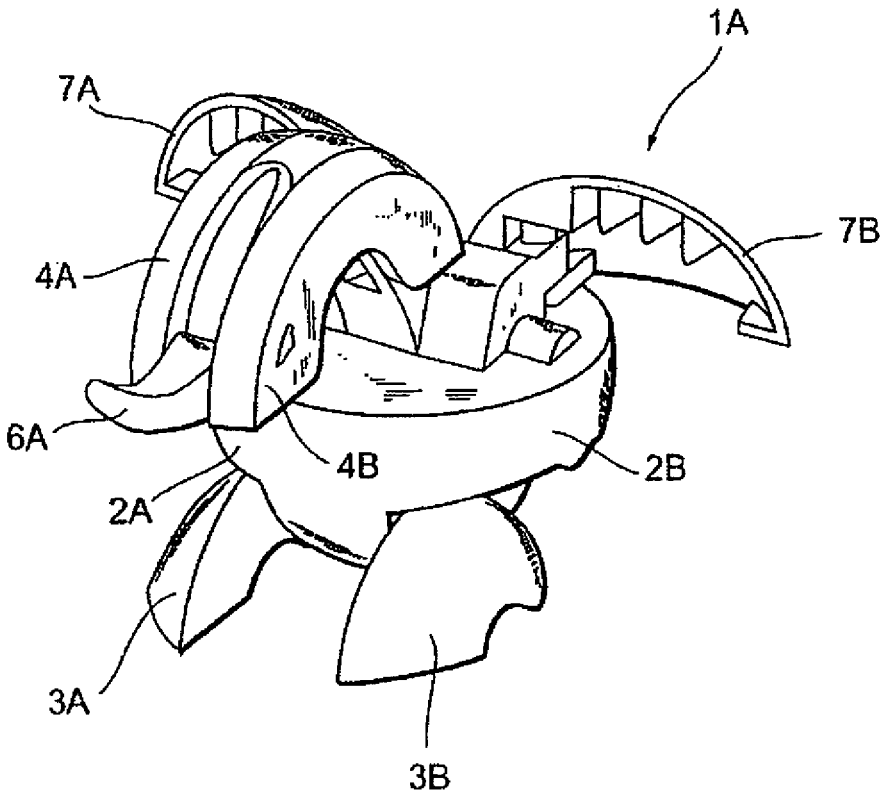
FIG. 15 is a perspective view of the toy shown in drawing 8, showing a post-transformation state.

Toy 1 pertaining to embodiment 1 of the present invention shall be described below with reference to drawings 1-7. Toy 1 pertaining to the present embodiment is an item that transforms from a rollable, spherical shape (the first shape: drawings 2-4) to a fictitious character shape (the second shape: drawing 7) symbolizing a "malevolent angel" by means of the action of a magnetic force.

Firstly, the construction of toy 1 pertaining to the present embodiment shall be described.

As shown in drawings 1-4, toy 1 is constructed of an exterior structure assigned to the exterior of toy 1, which forms an overall spherical shape, and an interior structure contained within the interior of the exterior structure. The exterior structure is endowed with a lower component 2 that constitutes the lower section of toy 1, an upper component 3 that constitutes the upper section of toy 1, and 4 lateral components 4-7 that constitute the circular section forming the upper and lower central region of toy 1. Further, the interior structure is endowed with a front component 8 assigned to the front interior location of toy 1, which constitutes the anterior portion of the character, a back component 9 assigned to the back interior location of toy 1, which constitutes the posterior portion of the character, a locking component 10 assigned to the interval between front component 8 and back component 9, a magnet 11 fixed to the lower end of locking component 10, a spring 12 that effects a force which moves locking component 10 upwardly, and support components 13 and 14 assigned to the left and right rear of back component 9, which support lateral components 4-7.

As shown in drawings 1-3, lower component 2 of the exterior structure expresses a slight dome shape, as if it were a section of a sphere that has been cut off, and the exterior surface thereof constitutes one section (the lower section) of the spherical shape. As shown in drawings 1 and 5, a circular through-hole 2*a* is furnished in the central region of lower component 2. Locking component 10, magnet 11 and spring 12 of the interior structure are assigned to the interior space of through-hole 2*a* in such a way that they can move in the interval between the central location and near-surface location of toy 1 in a rectilinear fashion. Here, as shown in drawing 5, there is a space formed for the movement of the magnet in the interval between magnet 11 and the near-surface vicinity of toy 1. Locking component 10 etc. for these components shall be described in detail below.

As shown in drawings 1-3, upper component 3 of the exterior structure expresses a slight dome shape, as if it were a section of a sphere that has been cut off, and the exterior surface thereof constitutes one section (the upper section) of the spherical shape. As shown in drawings 1 and 6, concave portion 3*a* is formed within the interior of upper component 3 in order to contain front component 8 and the upper portion of back component 9 (the head portion of the character). Further, as shown in drawings 1 and 2, notch portion 3*b* is furnished in the marginal portion of upper component 3. Back protruding portion 9*a* of back component 9 of the interior structure is inlaid in this notch portion 3*b*. And, as shown in drawing 2, upper component 3 is connected to back protruding portion 9*a* of back component 9 through turning axis 20 in such a way that it can turn. Here, upper component 3 is biased in such a way that it turns upwardly (namely, the direction in which it separates with respect to back component 9) by means of the elastic force of spring 30 assigned to the interval between upper component 3 and back component 9.

Further, as shown in drawings 1 and 6, cross section L-shaped convex portion 3*c* is furnished in the location opposite notch portion 3*b* of the marginal portion of upper component 3, and this convex portion 3*c* is such that it locks onto convex portion 4*b* of lateral component 4. As shown in drawing 6(*a*), in the event that lateral component 4 is closed, upper component 3 does not turn upwardly due to convex portion 3*c* of upper component 3 being locked onto convex portion 4*b* of lateral component 4. On the contrary, as shown in drawing 6(*b*), in the event that lateral component 4 is opened laterally, upper component 3 turns upwardly by means of the elastic force of spring 30, due to the locked state of convex portion 3*c* of upper component 3 and concave portion 4*b* of lateral component 4 being released.

As shown in drawing 1 etc., lateral components 4-7 of the exterior structure are husk-shaped components with a roughly circular arc shape, endowed with a particular thickness and width, and the exterior surfaces thereof constitute one section (the circular section forming the upper and lower central region) of the spherical shape by means of them combining. Bearing portions 4*a*-7*a* are furnished on one end of lateral components 4-7. The respective bearing portions 4*a* and 5*a* of the two upper and lower lateral components 4 and 5, which are assigned to the right side in drawings 1 and 3, etc., are inlaid in notch portion 13*a* of support component 13. And, these right-side lateral components 4 and 5 are connected to support component 13 through turning axis 21. Here, lateral component 4 is biased in such a way that it turns outwardly (namely, the direction in which it opens) by means of the elastic force of spring 31, which is assigned to the interval between lateral component 4 and support component 13. On the contrary, the respective bearing portions 6*a* and 7*a* of the two upper and lower lateral components 6 and 7, which are assigned to the left side in drawings 1 and 3, etc., are inlaid in notch portion 14*a* of support component 14. And, these left-side lateral components 6 and 7 are connected to support component 14 through turning axis 22. Here, lateral component 6 is biased in such a way that it turns outwardly (namely, the direction in which it opens) by means of the elastic force of spring 32, which is assigned to the interval between lateral component 6 and support component 14.

Further, protrusions 5*b* and 7*b* are respectively furnished on the upper side of the two left and right lateral components 5 and 7, which are assigned to the lower section in drawings 1 and 3, etc. Protrusion 5*b* of right side lateral component 5, which is assigned to the lower section, is inlaid in a groove portion of right side lateral section 4, which is assigned to the upper section, and is not shown in the drawings. By means of this, when upper right side lateral component 4 turns upon turning axis 21 by means of the elastic force of spring 31, lower right side lateral component 5 turns integrally with this lateral component 4. Further, protrusion 7*b* of left side lateral section 7, which is assigned to the lower section, is inlaid in a groove portion of left side lateral section 6, which is assigned to the upper section, and is not shown in the drawings. By means of this, when upper left side lateral component 6 turns upon turning axis 22 by means of the elastic force of spring 32, lower left side lateral component 7 turns integrally with this lateral component 6.

Further, as shown in drawings 1 and 5, U-shaped exterior locking portions 5*c* and 7*c*, which are respectively locked by the two left and right interior locking portions 10*c* and 10*c* of locking component 10 of the interior structure, are furnished on the inner side of the two left and right lateral components 5 and 7, which are assigned to the lower section in drawings 1 and 3, etc. As shown in drawing 5(*a*), in the event that a magnetic force has not acted on toy 1 and locking component 10 of the interior structure is upwardly biased by means of the elastic force of spring 12, lateral components 5 and 7 do not turn outwardly, due to exterior locking portion 5*c* of right side lateral component 5 and exterior locking portion 7*c* of left side lateral component 7 being locked respectively onto right side interior locking portion 10*c* and left side interior locking portion 10*c*. On the contrary, as shown in drawing 5(*b*), in the event that a magnetic force has acted on toy 1 and locking component 10 of the interior structure has moved downwardly, lateral components 4 and 6 (and lateral components 5 and 7, which turn simultaneously therewith) turn outwardly by means of the elastic force of springs 31 and 32, due to the locked state of interior locking portions 10*c* and 10*c* of locking component 10 and exterior locking portions 5*c* and 7*c* of lateral components 5 and 7 being released.

Furthermore, lateral components 4-7 of the exterior structure correspond to the first exterior turning component in the present invention, and turning axes 21 and 22 correspond to the exterior turning axes in the present invention. Further, upper component 3 corresponds to the second exterior turning component in the present invention, and turning axis 20 corresponds to the second exterior turning axis in the present invention. Further, spring 30, which effects a force that turns upper component 3, and springs 31 and 32, which effect a force that turns lateral components 4-7, correspond to the turning means and transformation means in the present invention.

As shown in drawings 1 and 5, front component 8 and back component 9 of the interior structure are assigned to the upper section of lower component 2 of the exterior structure, and constitute the body portion and head portion of the character by means of being combined and held together by screw 40. As shown in drawing 5, there is a space formed within in the interior of the back portion, which is constructed of the combination of front component 8 and back component 9, in order to house the vertical movement of locking component 10. This space is formed from the central location of toy 1 towards the near-surface location of toy 1 in such a way that it is in communication with the interior space of through-hole 2*a* of lower component 2, and is such that this space and magnet 11 are aligned in a near-rectilinear fashion. Further, support components 13 and 14 are mounted onto the left and right rear of back component 9.

As shown in drawings 1 and 5 etc., locking component 10 of the interior structure expresses a roughly T-shape and is endowed with a left-and-right extending portion 10*a* that extends in the left and right directions, and a tapered tubular portion 10*b* that extends downwards from the center of left-and-right extending portion 10*a*. And, interior locking portions 10*c* and 10*c* are furnished on both ends of left-and-right extending portion 10*a*, and magnet 11 is fixed onto the bottom end of tapered tubular portion 10*b*. Interior locking portions 10*c* and 10*c* are respectively locked onto exterior locking portions 5*c* and 7*c* of the exterior structure. As shown in drawing 5, magnet 11 is assigned to a location near the surface of toy 1 (the surface of lower component 2 of the exterior structure). As shown in drawing 5, the lower end of spring 12 is supported by means of support portion 2*b*, which is furnished on through-hole 2*a* of lower component 2, and is effected by an elastic force that propels the peripheral surface of tapered tubular portion 10*b* of locking component 10 upwardly. Furthermore, magnet 11 corresponds to the magnetic body in the present invention, and spring 12 corresponds to the biasing means in the present invention.

Next, the transformation action of toy 1 pertaining to the present embodiment shall be described, In the event that no metallic or other magnetic substance exists near magnet 11 of the interior structure of toy 1, magnet 11 does not move by means of a magnetic force, and locking component 10 is thereby maintained in a state of being pressed from the exterior towards the central region of toy 1 by means of the elastic force of spring 12 of the interior structure. As shown in drawing 5(*a*), in this state, exterior locking portions 5*c* and 7*c* of the exterior structure are locked by the left and right interior locking portions 10*c* and 10*c* of locking component 10 of the interior structure, and the spherical shape (the first shape) of the exterior structure as shown in drawings 2-4 is thereby maintained.

On the contrary, as shown in drawing 5(*b*), in the event that a metallic or other magnetic substance (metal-embedded card M) exists near magnet 11 of the interior structure of toy 1, a magnetic force that attracts magnet 11 and the magnetic substance acts. By means of the action of such a magnetic force, magnetic 11 and locking component 10 of the interior structure of toy 1 resist the elastic force of spring 12 and move integrally from the central location towards the exterior of toy 1, and the locked state of the left and right interior locking portions 10*c* and 10*c* of locking component 10 of the interior structure and exterior locking portions 5*c* and 7*c* of the exterior structure is thereby released.

Hereby, the exterior structure transforms to the character shape (the second shape) as shown in drawing 7 by means of springs 30, 31 and 32. Here, first, the locked state of interior locking portions 10*c* and 10*c* and exterior locking portions 5*c* and 7*c* is released, and lateral components 4-7 turn by means of the force of springs 31 and 32. Next, as shown in drawing 6(*b*), upper component 3 turns upwardly by means of the elastic force of spring 30, due to the locked state of convex portion 3*c* of upper component 3 and concave portion 4*b* of lateral component 4 being released by means of the turning of lateral components 4-7.

Further, to restore the shape of toy 1 from the character shape (the second shape) to the spherical shape (the first shape), first, work against the elastic force of spring 30 and turn upper component 3 of the exterior structure downwardly. Next, work against the elastic force of springs 31 and 32 and turn lateral components 4-7 of the exterior structure towards the front central area, lock convex portion 3*c* of upper component 3 and concave portion 4*b* of lateral component 4 while also locking exterior locking portions 5*c* and 7*c* of the exterior structure and interior locking portions 10*c* and 10*c* of the interior structure. By means of such an operation, the shape of the exterior structure of toy 1 is restored to a spherical shape. And, the spherical shape of toy 1 is maintained until a magnetic force acts once again.

in toy 1 pertaining to the embodiment described above, toy 1 can maintain a rollable, spherical shape (the first shape) until a force (magnetic force) that attracts magnet 11 acts from the exterior of toy 1. Consequently, the realization of games such as shooting games in which toy 1 pertaining to the present embodiment is sent running through a travel motion toy, for example, is potentiated. Further, simply by effecting a magnetic force from the exterior of toy 1, magnet 11 and locking component 10 within the interior of toy 1 move, and the locked state of interior locking portions 10*c* and 10*c* of the interior structure and exterior locking portions 5*c* and 7*c* of the exterior structure is thereby released, and toy 1 can hence automatically transform from the spherical shape to the character shape (the second shape). Consequently, by positioning a metallic etc. magnet in a particular location on a travel motion toy, for example, the sudden transformation of toy 1 traveling on the travel motion toy in a rollable, spherical shape to a different shape (the second shape), on this particular location, is potentiated. Further, because the mechanism for transforming toy 1 is relatively simple, the realization of the miniaturization of the toy is also potentiated. Hereby, the commercial value of the toy can be dramatically increased, and the impartation of fresh wonderment and intellectual excitement to its players is potentiated.

Further, in toy 1 pertaining to the embodiment described above, the exterior structure is constructed in such a way that it is restorable from the character shape (the second shape) to the spherical shape (the first shape), and moreover, in the event that the exterior structure has been restored to the spherical shape, a locked state of interior locking portions 10*c* and 10*c* and exterior locking portions 5*c* and 7*c* is realized, and this spherical shape is thereby maintained once again. Consequently, even after toy 1 has transformed from the spherical shape to the character shape by means of the action of a magnetic force, toy 1 can be restored to a rollable, spherical shape and re-used, and games such as shooting games can hence be carried out repeatedly.

Embodiment 2

Next, toy 1A pertaining to embodiment 2 of the present invention shall be described with reference to drawings 8-15. Toy 1A pertaining to the present embodiment is an item that transforms from a rollable, spherical shape (the first shape; drawings 9-11) to a fictitious character shape (the second shape: drawings 13-15) symbolizing a "fiendish dragon" by means of the action of a magnetic force.

Firstly, the construction of toy 1A pertaining to the present embodiment shall be described.

As shown in drawings 8-11, toy 1A is constructed of an exterior structure assigned to the exterior of toy 1A, which forms an overall spherical shape, and an interior structure contained within the interior of the exterior structure. The exterior structure is endowed with hemispherical structure components 2A and 2B that constitute the hemispherical portion assigned to the lower section of toy 1A, leg components 3A and 3B mounted onto the lower section of the hemispherical portion of toy 1A in such a way that they are turnable, central turning components 4A and 4B mounted onto the upper central portion of the hemispherical portion of toy 1A in such a way that they are turnable, and lateral turning components 7A and 7B etc. mounted onto the upper left and right lateral portions of the hemispherical portion of toy 1A in such a way that they are turnable. Further, the interior structure is endowed with an interior turning component 8A assigned to the interior of the hemispherical portion of toy 1A in such a way that it is turnable, a magnet 9A fixed to the lower section of interior turning component 8A, a turning locking component 10A that turns simultaneously with the turning of interior turning component 8A, a spring 11 that effects a force which turns turning locking component 10A in a particular direction, etc.

As shown in drawing 8, hemispherical structure components 2A and 2B of the exterior structure express a shape as if a hemisphere has been cut down the middle, and together constitute a hemispherical portion by means of being combined and held together by bolt 40A. A hollow portion is formed within the hemispherical portion, which is constructed by means of hemispherical structure components 2A and 2B, and interior turning component 8A, magnet 9A, turning locking component 10A, etc. of the interior structure are contained within this hollow portion. Further, a hole portion is formed on the lower section of the hemispherical portion, which is constructed by means of hemispherical structure components 2A and 2B, and is such that magnet 9A is exposed to the exterior from this hole portion. Interior turning component 9A etc. shall be described in detail below.

As shown in drawings 8 and 10, leg components 3A and 3B of the exterior structure are the parts that correspond to the leg portions of the character, and are connected to the lower lateral portions of hemispherical structure components 2A and 2B in such a way that they are turnable upon the respective turning axes thereof. As shown in drawings 13 and 15, leg components 3A and 3B can be used as the leg portions of the character by means of the player grasping a section thereof with his/her fingers and turning it approximately 180□. Further, as shown in drawings 10 and 11, in the event that leg components 3A and 3B are not used as the leg portions, the exterior surfaces of leg components 3A and 3B are such that they constitute one section of the spherical shape.

As shown in drawings 8-10, central turning components 4A and 4B of the exterior structure are roughly circular arc-shaped components endowed with a particular thickness, and the peripheral surfaces thereof constitute one section of the spherical shape. As shown in drawings 8 and 12, central turning components 4A and 4B are connected to hemispherical structure components 2A and 2B through connecting turning component 5A. First bearing portions 2Aa and 2Ba are furnished on the upper portion of hemispherical structure components 2A and 2B so that they connect to connecting turning component 5A respectively through left-and-right direction turning axis 20A (drawing 12) in such a way that they are turnable. One end of connecting turning component 5A is connected to the first bearing portions 2Aa and 2Ba of these hemispherical structure components 2A and 2B through turning axis 20A in such a way that it is turnable. Further, the other end of connecting turning component 5A is connected to one end of central turning components 4A and 4B through turning axis 21A in such a way that it is turnable. Here, connecting turning component 5A is assigned to the interval between central turning components 4A and 4B in such a way that is inserted therebetween. Further, central turning components 4A and 4B are biased in such a way that they turn backwardly by means of the elastic force of spring 30 assigned to the interval between connecting turning component 5A and central turning components 4A and 4B.

Further, as shown in drawings 8 and 12, L-shaped exterior locking portion 5Aa, which is locked onto interior locking portion 10Ac of turning locking component 10A of the interior structure, is furnished on connecting turning component 5A. As shown in drawing 12(*a*), in the event that a magnetic force does not act on toy 1A and interior locking portion 10Ac of the interior structure turns forwardly by means of the elastic force of spring 11A, connecting turning component 5A and central turning components 4A and 4B do not turn upwardly, due to exterior locking portion 5Aa of connecting turning component 5A being locked onto interior locking component 10Ac. On the contrary, as shown in drawing 12(*b*), in the event that a magnetic force has acted on toy 1A and interior locking portion 10Ac of the interior structure has turned backwardly, central turning components 4A and 4B turn backwardly by means of the elastic force of spring 30A, due to the locked state of interior locking portion 10Ac and exterior locking portion 5Aa being released. Hereupon, the exterior surfaces of central turning components 4A and 4B abut against convex portion 2Bb furnished on the backside of hemispherical structure component 2B, and central turning components 4A and 4B and connecting turning component 5A are propelled upwardly by means of the reactive force from this convex portion 2Bb. Further, central turning components 4A and 4B are pushed forwardly by means of the respective back end portions of lateral turning components 7A and 7B, which turn by means of the elastic force of springs 31A and 31B. Hereby, central turning components 4A and 4B and connecting turning component 5A turn upwardly and forwardly.

Further, horn component 6A is connected in the interval between central turning components 4A and 4B through turning axis 22A in such a way that it is turnable. As shown in drawings 13-15, horn component 6A can be used as the horn portion of the character by means of the player grasping the tip thereof with his/her fingers and turning it a predetermined angle. As shown in drawings 9-11, in the event that horn component 6A is not used as the horn portion, the exterior surface of horn component 6A is such that it constitutes one section of the spherical shape.

As shown in drawings 8-11 etc., lateral turning components 7A and 7B of the exterior structure express a shape as if a hemisphere has been cut down the middle, and the size thereof is slightly smaller than that of hemispherical structure components 2A and 2B. As shown in drawings 8 and 14, lateral turning components 7A and 7B are connected to the upper portion of hemispherical structure components 2A and 2B in such a way that they are turnable. Second bearing portions 2Ac and 2Bc are furnished on the upper portion of hemispherical structure components 2A and 2B so that they connect to lateral turning components 7A and 7B respectively through up-and-down direction turning axes 23A and 23B in such a way that they are turnable. One end of lateral turning components 7A and 7B is connected to the second bearing portions 2Ac and 2Bc of these hemispherical structure components 2A and 2B through turning axes 23A and 23B in such a way that they are turnable. Here, lateral turning components 7A and 7B are biased in such a way that they turn backwardly by means of the elastic force of springs 31A and 3B assigned to the interval between lateral turning components 7A and 7B and hemispherical structure components 2A and 2B.

As shown in drawing 12(*a*), in the event that a magnetic force does not act on toy 1A and central turning components 4A and 4B and connecting turning component 5A do not turn, lateral turning components 7A and 7B do not turn, due to the respective back end portions of lateral turning components 7A and 7B abutting against the respective back end portions of central turning components 4A and 4B. On the contrary, in the event that a magnetic force has acted on toy 1A and central turning components 4A and 4B have turned upwardly, the turning of lateral turning components 7A and 7B is allowed, due to a slight gap on the back sections of the respective back end portions of central turning components 4A and 4B, into which the respective back end portions of lateral turning components 7A and 7B can enter, being formed. And, central turning components 4A and 4B, which were pushed forwardly by means of the respective back end portions of lateral turning components 7A and 7B, then turn upwardly and forwardly.

Furthermore, central turning components 4A and 4B and connecting turning component 5A of the exterior structure correspond to the first exterior turning components in the present invention, and turning axes 20A and 21A correspond to the first exterior turning axes in the present invention. Further, lateral turning components 7A and 7B correspond to the second exterior turning components in the present invention, and turning axes 23A and 23B correspond to the second exterior turning axes in the present invention. Further, spring 30A, which effects a force that turns central turning components 4A and 4B, and springs 31A and 31B, which effect a force that turns lateral turning components 7A and 7B, correspond to the turning means and transformation means in the present invention.

As shown in drawings 8 and 12 etc., interior turning component 8A of the interior structure is endowed with large circular tubular portion 8Aa, extending portion 8Ab furnished in such a way that it extends in one direction from large circular tubular portion 8Aa, and two protrusions 8Ac and 8Ac furnished in such a way that they extend from large circular tubular portion 8Aa in a roughly perpendicular direction to the extension direction of extending portion 8Ab. Large circular tubular portion 8Aa of interior turning component 8A is connected with bolt 40B to turning axis portion 2Bb, which is furnished in the interior of hemispherical structure component 2B. By means of this, interior turning component 8A is turnable upon the left-and-right direction turning axis (the first interior turning axis). Further, magnet 9A is fixed on the lower end of extending portion 8Ab of interior turning component 8A. As shown in drawing 12, magnet 9A is assigned to a location near the surface of toy 1A (the surface of hemispherical structure components 2A and 2B of the exterior structure). Further, as shown in drawing 12, a space only allowing for magnet 9A to turn is furnished in the interval between magnet 9A and the near-surface location of toy 1A, and this space and magnet 9A are positioned in a near-rectilinear fashion in the interval between the central location of toy 1A and the near-surface location of toy 1A.

As shown in drawings 8 and 12 etc., turning locking component 10A of the interior structure is endowed with small circular tubular portion 10Aa, protruding portion 10Ab furnished in such a way that it protrudes in one direction from small circular tubular portion 10Aa, and L-shaped interior locking portion 10Ac furnished in such a way that it extends from small circular tubular portion 10Ac in an opposite direction to protruding portion 10Ab. Small circular tubular portion 10Aa of turning locking component 10A is connected through pin 50A to interior bearing portion 2Be, which is furnished in the interior of hemispherical structure component 2B. By means of this, turning locking component 10A is turnable upon the left-and-right direction turning axis (the second interior turning axis). Here, turning locking component 10A is biased in such a way that it turns in a particular direction (the direction in which interior locking portion 10Ac, which is positioned on the upper section, turns forwardly) by means of the elastic force of spring 11A, which is assigned to the interval between turning locking component 10A and hemispherical structure component 2B. As shown in drawing 12, protruding portion 10Ab of turning locking component 10A is inlaid in the interval between the two protrusions 8Ac and 8Ac of interior turning component 8A in such a way that it is swingable. Further, interior locking portion 10Ac of interior turning component 8A is locked onto exterior locking portion 5Aa of connecting turning component 5A of the exterior structure. Furthermore, interior turning component 8A of the interior structure corresponds to the first interior turning portion in the present invention, turning locking component 10A corresponds to the second interior turning portion in the present invention, and spring 11A corresponds to the biasing means in the present invention.

Next, the transformation action of toy 1A pertaining to the present embodiment shall be described.

In the event that no metallic or other magnetic substance exists near magnet 9A of the interior structure of toy 1A, magnet 9A does not move by means of a magnetic force, and turning locking component 10A is thereby maintained in a state of being biased in a particular direction (the direction in which interior locking portion 10Ac, which is positioned on the upper section, turns forwardly) by means of the elastic force of spring 11A of the interior structure. As shown in drawing 12(*a*), in this state, exterior locking portion 5Aa of connecting turning component 5A of the exterior structure is locked by interior locking portion 10Ac of turning locking component 10A of the interior structure, and the spherical shape of the exterior structure as shown in drawings 9-11 is thereby maintained.

On the contrary, as shown in drawing 12(*b*), in the event that a metallic or other magnetic substance (metal-embedded card M) exists near magnet 9A of the interior structure of toy 1A, a magnetic force that attracts magnet 9A and the magnetic substance acts. By means of this, magnet 9A of the interior structure and interior turning component 8A of the interior structure of toy 1A turn integrally in direction R1 of drawing 12. When interior turning component 8A turns in such a way, protruding portion 10Ab of turning locking component 10A, which is inlaid in the two protrusions 8Ac and 8Ac of interior turning component 8A, swings forwardly, and the locked state of interior locking portion 10Ac of turning locking component 10A and exterior locking portion 5Aa of connecting turning component 5A is released due to turning locking component 10A turning in direction R2 of drawing 12.

Hereby, the exterior structure transforms to the character shape (the second shape) as shown in drawings 13-15 by means of springs 30A, 31A and 31B. Here, first, the locked state of interior locking portion 10Ac and exterior locking portion 5Aa is released, and central turning components 4A and 4B and connecting turning component 5A turn by means of the elastic force of spring 30A. Next, lateral turning components 7A and 7B move backwardly by means of the elastic force of springs 31A and 31B, due to the turning of lateral turning components 7A and 7B being allowed by means of the turning of central turning components 4A and 4B.

Further, to restore the shape of toy 1A from the character shape (the second shape) to the spherical shape (the first shape), first, work against the elastic force of springs 31A and 31B and turn lateral turning components 7A and 7B of the exterior structure forwardly. Next, work against the elastic force of spring 30 and turn central turning components 4A and 4B and connecting turning component 5A backwardly, and lock exterior locking portion 5Aa of the exterior structure and interior locking portion 10Ac of the interior structure. By means of such an operation, the shape of the exterior of toy 1A is restored to a spherical shape. And, the spherical shape of toy 1A is maintained until a magnetic force acts once again.

In toy 1A pertaining to the embodiment described above, toy 1A can maintain a rollable, spherical shape (the first shape) until a force (magnetic force) that attracts magnet 9A acts from the exterior of toy 1A. Consequently, the realization of games such as shooting games in which toy 1A pertaining to the present embodiment is sent running through a travel motion toy, for example, is potentiated. Further, simply by effecting a magnetic force from the exterior of toy 1A, magnet 9A and interior turning component 8A within the interior of toy 1A turn, and the locked state of interior locking portion 10Ac of the interior structure and exterior locking component 5Aa of the exterior structure is thereby released, and toy 1A can hence automatically transform from the spherical shape to the character shape (the second shape). Consequently, by positioning a metallic etc. magnet in a particular location on a travel motion toy, for example, the sudden transformation of toy 1A traveling on the travel motion toy in a rollable, spherical shape to a different shape (the second shape), on this particular location, is potentiated. Further, because the mechanism for transforming toy 1A is relatively simple, the realization of the miniaturization of the toy is also potentiated. Hereby, the commercial value of the toy can be dramatically increased, and the impartation of fresh wonderment and intellectual excitement to its players is potentiated.

Further, in toy 1A pertaining to the embodiment described above, the exterior structure is constructed in such a way that it is restorable from the character shape (the second shape) to the spherical shape (the first shape), and moreover, in the event that the exterior structure has been restored to the spherical shape, a locked state of interior locking portion 10Ac and exterior locking portion 5Aa is realized, and this spherical shape is thereby maintained once again. Consequently, even after toy IA has transformed from the spherical shape to the character shape by means of the action of a magnetic force, toy IA can be restored to a rollable, spherical shape and re-used, and games such as shooting games can hence be carried out repeatedly.

Furthermore, the present invention is not limited to the above embodiments; a variety of transformations are possible without departing from the scope thereof. For example, in the above embodiments, although examples of the realization of the transformation of the toy by means of placing a magnet in the interior of the toy in such a way that it is movable (turnable) and placing a metallic or other magnetic substance at the exterior of the toy and causing the magnetic inside the toy to move (turn) have already been shown, the transformation of the toy may also be realized by means of placing a metallic or other magnetic substance in the interior of the toy in such a way that it is movable (turnable) and placing a magnet at the exterior of the toy, which attracts the magnetic substance inside the toy and causes it to move (turn).

Further, in the above embodiments, although examples of the realization of the transformation of the toy by means of attracting the magnetic substance (magnet) inside the toy and causing it to move from the central location to the near-surface location of the toy have already been shown, the aspect of the moving (turning) of the magnetic substance (magnet) inside the toy is not limited to this. For example, the employment of a structure that causes the magnetic substance inside the toy to move (turn) from the near-surface location to the central location of the toy, by means of causing the magnetic pole of the magnetic substance on the exterior and the magnetic pole of the magnetic substance inside the toy to repel each other and thereby realize the transformation of the toy, is also possible. To employ such a structure, interchange the magnet assigned to the interval between the central location of the toy and the near-surface location of the toy (for example, magnets 11 and 9A in the said embodiments) and the moving space of the magnet and location thereof, and at the very least furnish the interval between the center of the toy and the magnet with this space.

Further, in the above embodiments, although examples in which a "spherical shape" is employed as the first shape of the toy have already been shown, other rollable shapes (a rugby ball shape or a circular, tubular shape, for example) can also be employed as the first shape of the toy. Further, the second shape of the toy is also not particularly limited; a variety of shapes can be employed.

Further, in the above embodiments, although examples in which springs were employed as the biasing means, transformation means and turning means, rubber or other elastic bodies can also be employed as the biasing means, etc.

EXPLANATION OF LETTERS AND NUMBERS

1 & 1A Toy

3 Upper component (the second exterior turning component)

4-7 Lateral components (the first exterior turning components)
4A & 4B Central turning components (the first exterior turning components)
5A Connecting turning component (the first exterior turning component)
7A & 7B Lateral turning components (the second exterior turning components)
5*c*, 7*c* & 5Aa Exterior locking portions
8A Interior turning component (the first interior turning portion)
10A Turning locking component (the second interior turning portion)
10*c* & 10Ac Interior locking portion
11 & 9*a* Magnet (magnetic body)
12 & 11A Springs (biasing means)
20 Turning axis (the second exterior turning axis)
21 & 22 Turning axes (the first exterior turning axes)
30, 31 & 32 Springs (transformation means, turning means)

We claim:

1. A toy comprising a main body element and at least one first moveable element associated with said main body element and moveable with respect thereto from a first position adjacent said main body element in which the toy is rollable along a playing surface containing a metal or magnetic material, to a second position in which at least a portion of said first moveable element has moved away from said main body element and the toy is not rollable along the playing surface, said at least one first moveable element being permanently biased toward said second position, and being provided with catch means co-operable with moveable releasable latch means in said main body element to maintain at least one said first moveable element in said first position until said latch means is released, wherein said releasable latch means is provided with a magnet, whereby said releasable latch means is moveable out of engagement with said catch by attraction to said playing surface, whereby a rolling of the toy along the playing surface ceases when said latch means is moved out of engagement with said catch.

2. The toy as claimed in claim 1, wherein said main body element, together with said at least one first moveable element, are a first shape when said at least one first moveable element is in said first position, and a second shape when said at least one first moveable element is in said second position.

3. The toy as claimed in claim 2, wherein said first shape is selected from the group consisting of spheres, cubes, tetrahedrons, pyramids, triangular prisms, egg shapes, parallelepipeds, cylinders, discus shapes, toruses, teardrops, lozenges, animal shapes, planet shapes, robot shapes, vehicle shapes, building shapes, tree shapes, sports equipment related shapes, weapons shapes, character-head shapes, and the like.

4. The toy as claimed in claim 3, wherein said releasable latch means is biased to a position in engagement with said catch.

5. The toy as claimed in claim 1, further comprising at least one second moveable element, hinged to said at least one first moveable element and moveable from a closed position adjacent said at least one first moveable element, to an open position away from said at least one first moveable element, said at least one second moveable element being biased toward said open position, and foldable to said closed position, said at least one second moveable element being restrained against movement toward said open position while said catch is in engagement with said releasable latch means.

6. A transformable toy movable between a first shape of a sphere and a second shape of a character, said toy comprising:

an outer structure formed with a plurality of outer members rotatably connected with adjoining ones and elastic means disposed between the rotatably adjoining outer members, wherein, when assembled, said outer members are combined to provide the first shape of the sphere which is rollable along a playing surface, and wherein, when transformed into the second shape such that rolling of the toy along the playing surface substantially ceases, the outside members are configured to constitute part of said character;

an inner structure formed with at least an inner member which constitutes another part of said character wherein the inner member is held within an inner space constituted by the combined outer members in the first shape so that the inner member is not seen from the outside when the toy is in the first shape; and a holding means formed with an inner magnetic member arranged movably inside of the toy for holding said plurality of outer members in a holding state against the elastic force of the elastic means to maintain the toy in the first shape, wherein a magnetic force, which may operate between the inner magnetic member and an outer magnetism member arranged at a location along the playing surface on which the toy in the first shape of the sphere rolls over in response to being rolled by the user, interaction between the outer magnetism member and the inner magnetic member causes the inner magnetic member to move and such movement of the inner magnetic member causes the holding member to release the holding state, and said plurality of outer member burst open outwardly by the released elastic force of the elastic means, and the hidden inner member to appear whereby a rolling of the toy along the playing surface ceases, the toy transforms from the first shape to the second shape and said character configured by said plurality of outer member and said inner member pops up.

7. The toy according to claim 6, wherein said inner member constitutes a head of the character and is hidden in the inner space of the sphere in the first shape, and wherein the character is constituted with the inner member as the head and said plurality of the outer members burst open outwardly in the second state.

8. The toy according to claim 6, wherein said outer structure further comprises a lower member the lower surface of which is formed of a hemisphere, wherein the inner members to constitute a head and a body of the character are arranged on the upper portion of the lower member, wherein an opening is formed at lower portion of said hemisphere and said inner magnetic member is movably disposed in the opening.

9. A transformable toy comprising:

a plurality of character-forming members to constitute a character;

a lower member;

a holding member;

an inner magnetic member movably disposed inside of said lower member and configured to move when a magnetic force is operated between the inner magnetic member and an outer magnetism member; and elastic members;

wherein said plurality of character-forming members and said lower member are maintained to a first shape by maintaining at least some of said plurality of character-forming members at a predetermined arrangement against elastic forces of the elastic members by said holding member under surroundings without the magnetic force with the outer magnetism member, wherein, when a magnetic force is operated between the inner magnetic member and the outer magnetism member, such magnetic force causes the inner magnetic member to move to release the holding member, thereby to cause said plurality of character-forming members and said lower member to transform to a second shape of a character, wherein said plurality of character-forming members comprise at least an inner member and a plurality of outer members, which are configured to constitute the character when transformed to the second shape, wherein, in the first shape, said outer members are arranged to constitute an outer shape together with said lower member the outer shape capable of being rolled or tumbled, to provide an inner space in which said inner member is held such that the inner member is not seen from the outside, and to maintain such outer shape against elastic forces of the elastic members by the holding member, whereby the toy rolls over a playing surface in response to rolling by a user while such outer shape is maintained, wherein, when the toy reaches a location on the playing surface at which the outer magnetism member is arranged, the inner magnetic member moves by the magnetic force of interaction with the outer magnetism member to release the holding member, thereby ceasing rolling movement of the toy over the playing surface, wherein said outer members move outwardly by the elastic forces of the released elastic members to cause the hidden inner member to appear whereby the character, which is composed of said plurality of outer members and said inner member, appears.

* * * * *